US005484103A

United States Patent [19]

Schultz

[11] Patent Number: 5,484,103

[45] Date of Patent: Jan. 16, 1996

[54] CONTROL DEVICE AND METHOD OF MAKING THE SAME

[75] Inventor: Gilbert Schultz, Fullerton, Calif.

[73] Assignee: Robertshaw Controls Company, Richmond, Va.

[21] Appl. No.: 334,559

[22] Filed: Nov. 4, 1994

[51] Int. Cl.[6] ..... C05D 15/00; F23D 5/16

[52] U.S. Cl. ..... 236/68 D; 137/66

[58] Field of Search ..... 236/68 D, 15 A, 236/20; 137/66

[56] References Cited

U.S. PATENT DOCUMENTS 3,090,560 5/1963 Holzboog et al. ..... 236/68 D 3,507,037 4/1970 Dykzeul ..... 29/592

3,508,708 4/1970 Caparone et al. ..... 236/33

4,285,662 8/1981 Katchka et al. ..... 431/53

5,326,029 7/1994 Schultz ..... 236/68 D

*Primary Examiner*—William E. Wayner

*Attorney, Agent, or Firm*—Fulbright & Jaworski

[57] ABSTRACT

A control device and method of making the same are provided, the control device having an axially movable shaft for moving a movable valve into its latching position with an electromagnetic unit and also being rotatable from a first position thereof to a second position thereof to cause an electrical switch to be in a closed condition thereof, the switch being a normally closed switch and being in series with the electromagnetic unit so that the electromagnetic unit can not have an electrical current flowing therethrough unless the switch is in the closed condition thereof.

20 Claims, 4 Drawing Sheets

CONTROL DEVICE AND METHOD OF MAKING THE SAME

BACKGROUND OF THE INVENTION

1. Field of the Invention

This invention relates to a new control device, such as a control device for a water heater, and to a new method of making such a control device.

2. Prior Art Statement

It is known to provide a control device comprising a housing means, an electromagnetic means carried by the housing means, a movable valve means carried by the housing means and normally being disposed in a first operating position thereof and being adapted to be held in a second operating position thereof by the electromagnetic means as long as the electromagnetic means remains energized, electrical switch means carried by the housing means and being operatively interconnected to the electromagnetic means so that the electromagnetic means is adapted to be energized when the switch means is in a first operating condition thereof and is prevented from being energized when the switch means is in a second operating condition thereof, and a shaft means carried by the housing means and being adapted to be axially moved from a first axial position thereof to a second axial position thereof so as to engage the valve means and move the valve means from the first operating position thereof to the second operating position thereof, the shaft means having actuator means operatively interconnected to the switch means and being rotatably movable from a first rotatable position thereof to a second rotatable position thereof to cause the switch means to be in the first operating condition thereof, the switch means being a normally open switch means. For example, see the U.S. patent to Schultz, U.S. Pat. No. 5,326,029.

SUMMARY OF THE INVENTION

It is one of the features of this invention to provide a new control device wherein the axially movable shaft means thereof that is normally utilized to move a valve means into its latching position with an electromagnetic means of the control device is utilized in an unique manner to control an electrical switch means of the control device.

In particular, it has been found according to the teachings of the invention disclosed in the aforementioned U.S. patent to Schultz, U.S. Pat. No. 5,326,029, that an electrical switch means can be carried by the housing means of the control device and be operatively interconnected to the electromagnetic means so that the electromagnetic means is adapted to be energized when the switch means is in a first operating condition thereof and is prevented from being energized when the switch means is in a second operating condition thereof, the axially movable shaft means being provided with actuator means that is operatively interconnected to the switch means and being rotatably movable from a first rotatable position thereof to a second rotatable position thereof to cause the switch means to be in the first operating condition thereof.

However, the switch means in such prior known control device is a normally open switch means which must be moved to and then be held in a closed condition thereof in order to be in first operating condition thereof.

In contrast, the switch means in the control device of this invention is a normally closed switch means that is uniquely operated by the shaft means thereof.

For example, one embodiment of this invention comprises a control device comprising a housing means, a movable valve means carried by the housing means and normally being disposed in a first operating position thereof and being adapted to be held in a second operating position thereof by the electromagnetic means as long as the electromagnetic means remains energized, electrical switch means carried by the housing means and being operatively interconnected to the electromagnetic means so that the electromagnetic means is adapted to be energized when the switch means is in a first operating condition thereof and is prevented from being energized when the switch means is in the second operating condition thereof, and a shaft means carried by the housing means and being adapted to be axially moved from a first axial position thereof to a second axial position thereof so as to engage the valve means and move the valve means from the first operating position thereof to the second operating position thereof, the shaft means having actuator means operatively interconnected to the switch means and being rotatably movable from a first rotatable position thereof to a second rotatable position thereof to cause the switch means to be in the first operating condition thereof, the switch means comprising contact means normally disposed in the closed condition thereof which comprises the first operating condition of the switch means, the actuator means of the shaft means engaging and holding the contact means in an open condition thereof when the shaft means is in the first rotatable position thereof whereby the open condition of the contact means comprises the second operating condition of the switch means.

Accordingly, it is an object of this invention to provide a new control device having one or more of the novel features of this invention as set forth above or hereinafter shown or described.

Another object of this invention is to provide a new method of making such a control device, the method of this invention having one or more of the novel features of this invention as set forth above or hereinafter shown or described.

Other objects, uses and advantages of this invention are apparent from a reading of this description which proceeds with reference to the accompanying drawings forming a part thereof in wherein:

DESCRIPTION OF THE PREFERRED EMBODIMENT

While the various features of this invention are hereinafter illustrated and described as being particularly adapted to provide a control device for a water heater, it is to be understood that the various features of this invention can be utilized singly or in various combinations thereof to provide a control device for other apparatus as desired.

Therefore, this invention is not to be limited to only the embodiment illustrating inn the drawings, because the drawings are merely utilized to illustrate one of the wide variety of uses of this invention.

Figure 1:
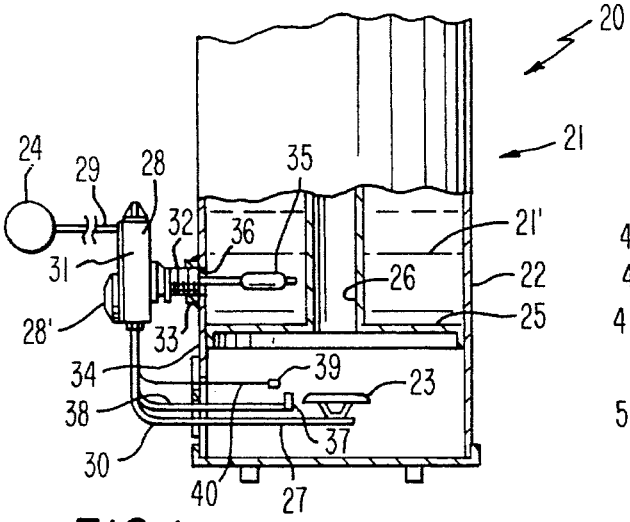
FIG. 1 is a schematic view illustrating the control system of this invention for controlling the operation of a water heater.

Referring now to FIG. 1, the new control system of this invention is generally indicated by the reference numeral 20 and is being utilized to control a water heater that is generally indicated by the reference numeral 21 in FIG. 1 and comprises a tank 22 for containing water 21' therein and a main burner means 23 for receiving fuel, such as natural or synthetic gas, from a source 24 and issuing the fuel therefrom so as to burn and heat the tank 22 and, thus, the water 21' therein by conduction in a manner well known in the art.

The tank 22 has a bottom wall means 25 and a flue passage 26 extending upwardly from a central area of the bottom wall means 25 for conveying away combustion products of the burner means 23 also in a manner well know in the art.

The fuel from the source 24 is directed to the burner means 23 by a conduit means 27 under the control of a control device 28 of this invention that is disposed intermediate the source 24 and the burner means 23 so that a first portion 29 of the conduit means 27 leads from the source 24 to the control device 28 and a second portion 30 of the conduit means 27 leads from the control device 28 to the burner means 23 in a manner well know in the art.

The control device 28 comprises a housing means 31 having an externally threaded shank portion 32 threaded into an internally threaded spud 33 carried on a wall 34 of the tank 22 and permitting a temperature sensing rod and tube unit 35 of the control device 28 to project through an opening 36 in the wall 34 of the tank 22 so as to be disposed in the water 21' in the tank 22 while the control device 28 is held in the position illustrated in FIG. 1 by the threaded interconnection between the shank 32 and the spud 33 all in a manner well known in the art.

The system 20 of this invention includes a pilot burner means 37 disposed adjacent the main burner means 23 and being supplied fuel from the control device 28 through a conduit means 38 in a manner hereinafter set forth.

In addition, the control system 20 of this invention includes a flame detecting means 39 disposed adjacent the pilot burner means 37 and being interconnected to the control device 28 by electrical conductor means 40 also in a manner well known in the art.

In general, the parts of the system 20 previously described are well known in the art. For example, see the U.S. patent to Katchka et al, U.S. Pat. No. 4,285,662, the U.S. patent to Caparone et al, U.S. Pat. No. 3,508,708 and the U.S. patent to Dykzeul U.S. Pat. No. 3,507,307 whereby these three U.S. patents are being incorporated into this disclosure by this reference thereto.

Therefore, a detailed discussion of the structure and the operation of the various parts of the system 20 is deemed unnecessary. However, sufficient details of such prior known structure will be hereinafter set forth in order to fully understand the various features of this invention.

Referring now to FIGS. 3–9, the housing means 31 of the control device 28 has an inlet 41 for interconnecting to the portion 29 of the conduit means 27 that leads from the fuel source 24 and an outlet 42 for interconnecting to the portion 30 of the conduit 27 that leads to the burner means 23, the housing 31 having another outlet 43 for interconnecting to the conduit 38 that leads to the pilot burner means 37.

While the housing means 31 can be formed of any suitable material, the same comprises metallic material suitably cast and machined as is well know in the art.

Figure 6:
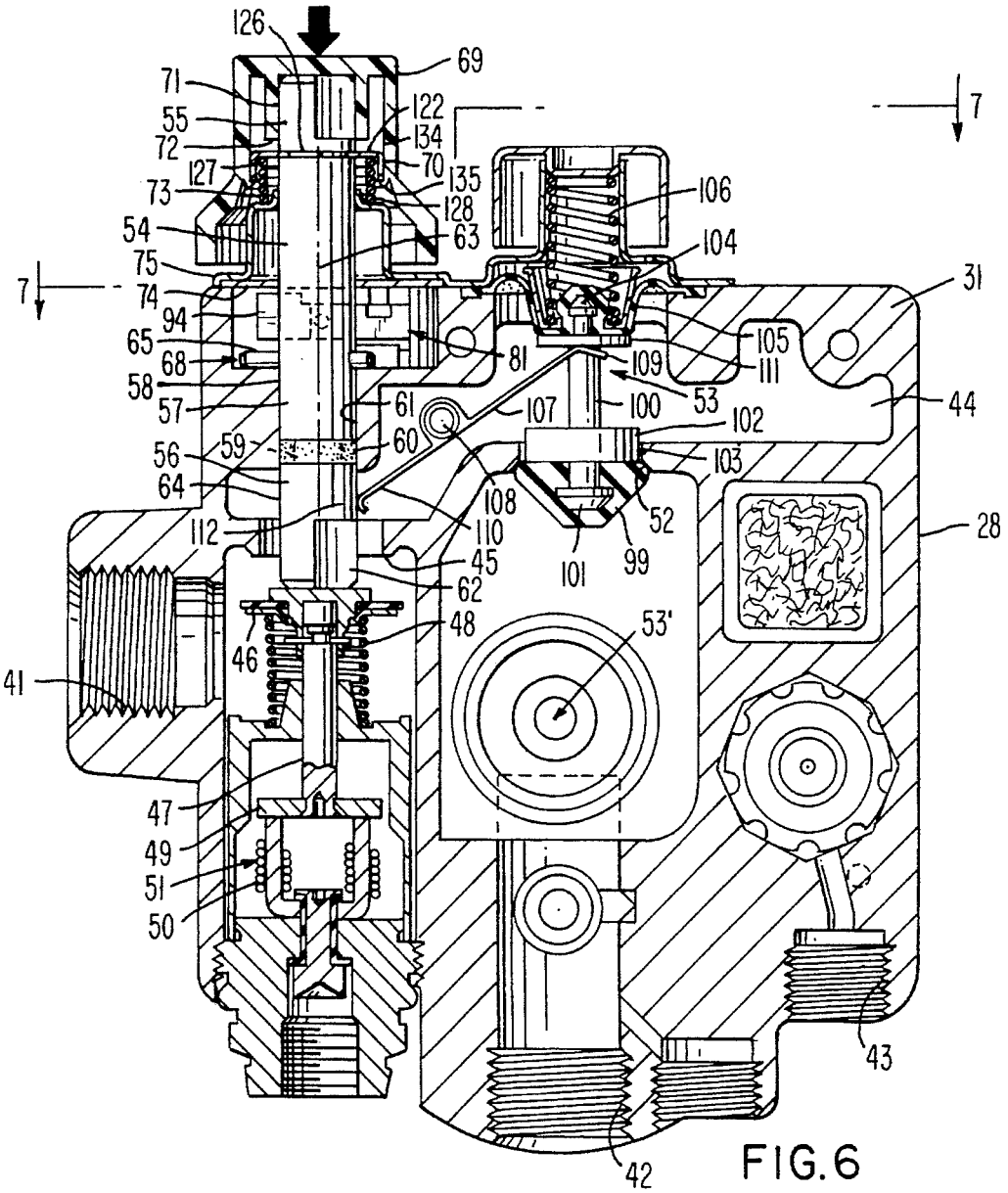
FIG. 6 is a view similar to FIG. 3 and illustrates the control device set in the "pilot light" position thereof.
Figure 8:
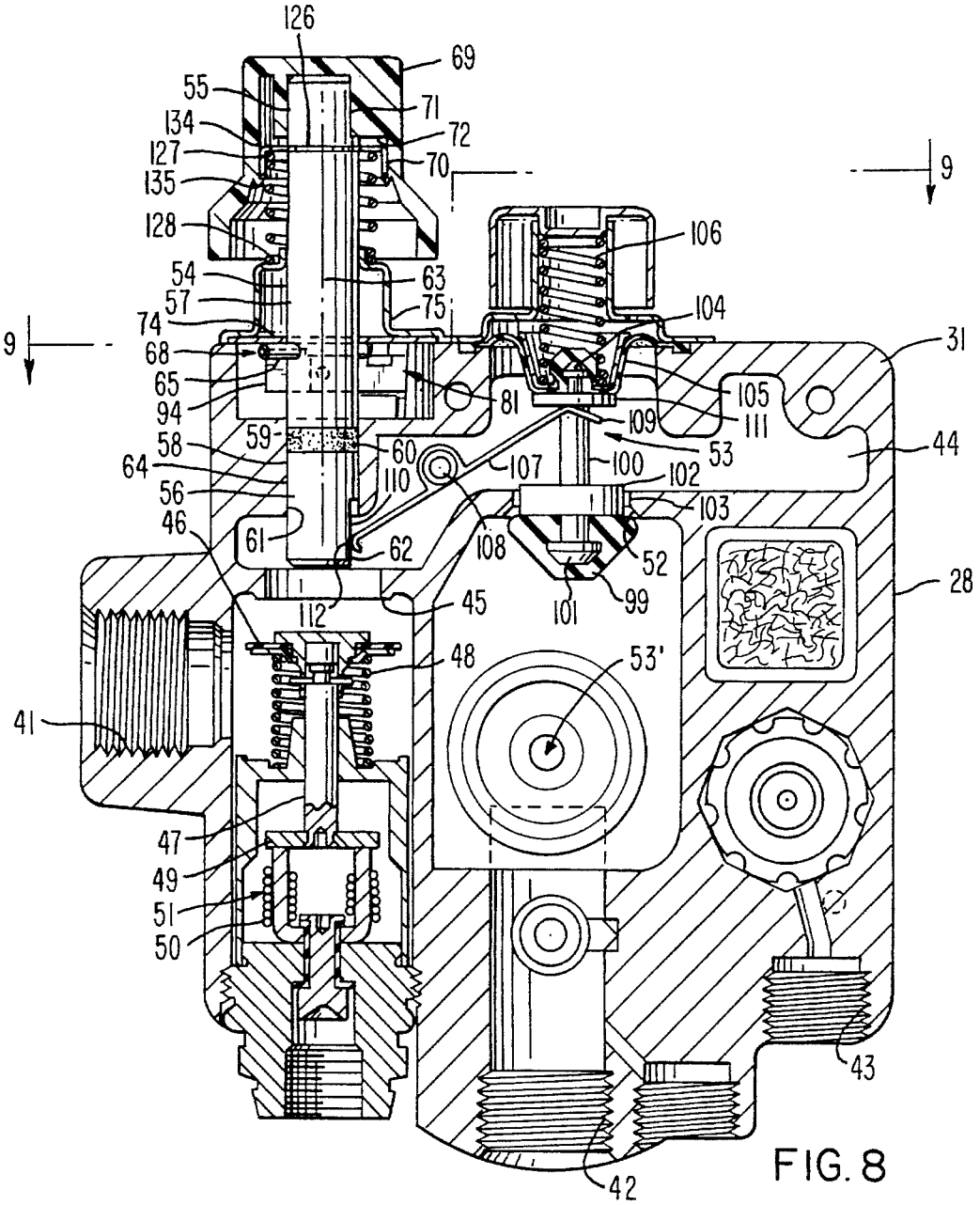
FIG. 8 is a view similar to FIG. 6 and illustrates the control device in the "on" condition thereof.

The housing means 31 of the control device 28 has a chamber 44 separated from the inlet 41 by a valve seat 45 that is controlled by a movable valve member 46 that is carried on a stem 47 and that is normally urged to a closed position against the valve seat 45 by a compression spring 48, the stem 47 carrying an armature 49 that is adapted to be held in a latched position as illustrated in FIGS. 6 and 8 when an electrical current passes through a coil means 50 of an electromagnetic means 51 carried in the housing means 31 all in a manner well known in the art. However, when the current ceases to flow through the coil means 50 of the electromagnetic means 51, the compression spring 48 moves the valve member 46 to its closed condition against the valve seat 45 preventing the inlet 41 from being interconnected to the chamber 44.

The chamber means 44 of the housing means 31 of the control device 28 is directly interconnected to the pilot outlet 43 through suitable passages in the housing means 28 so that as long as the movable valve means 46 is in an open condition, fuel is adapted to flow from the source 24 to the pilot burner means 37. However, the chamber 44 of the housing means 31 of the control device 28 is interconnected to the main outlet 42 first through a valve seat 52 of a pressure regulator valve means 53 and then through a temperature controlled valve means 53' in a manner well known in the art.

In particular, the rod and tube temperature sensing means or unit 35 previously described controls the valve means 53' so that when the temperature of the water 21' in the tank 22 falls below a temperature setting of a control device 28, such as being selected by a person setting the control knob 28' of the control device 28 as illustrated in FIG. 1 in a manner well know in the art, the temperature sensing means 35 opens the valve means 53' so that pressure regulated fuel is now adapted to pass to the main burner means 23 to be ignited by the pilot burner 37 and thereby heat the water 21' in the tank 22 until the temperature sensing means 35 senses that the temperature of the water 21' in the tank 22 has risen to or above the selected temperature and causes the valve means 53' to close.

As is well known in the prior art, the flame detecting means 39 that detects flame at the pilot burner means 37 comprises a thermocouple that will generate an electrical current flow through the coil means 59 of the electromagnetic means 51 as long as a flame appears at the pilot burner means 37 as fully disclosed in the aforementioned U.S. patent to Katchka et al, U.S. Pat. No. 4,285,662.

Therefore, some means must be provided to move the valve means 46 to its open condition and its latching position as illustrated in FIG. 6 so that fuel can flow to the pilot burner means 37 to be ignited either manually or automatically so that the thus burning pilot burner means 37 will cause the thermocouple 39 to generate an electrical current to flow through the coil means 50 and thereby hold the armature 49 of the valve means 46 in its open condition.

Such means of this invention comprises an unique shaft means 54 having opposed ends 55 and 56 and an intermediate substantially cylindrical section 57 that is adapted to move axially upwardly and downwardly in a cylindrical opening 58 in the housing means 31 of the control device 28 while being rotatable therein as will be apparent hereinafter, the shaft means 54 having an annular groove 59 in the cylindrical section 57 thereof and containing an annular O-ring sealing member 60 which seals against an internal peripheral surface 61 of the housing means 31 that defines the opening 58. The end 56 of the shaft 54 has a flat surface 62 that is disposed closer to a longitudinal axis 63 of the shaft 54 than the remaining arcuate surface means 64 of the end 56. The shaft 54 carries a transverse pin 65 in an opening 66 formed through the cylindrical section 57 thereof. Thus, the end 56 of the shaft 54 comprises a first cam means or actuator means 67 and the pin 65 of the shaft 54 comprises a second cam means or actuator means 68 whereby the actuator means 67 and 68 of the shaft 54 are uniquely utilized to respectively control other operating structure of the control device 28 as will be apparent hereinafter.

A control knob 69 is carried on the end 55 of the shaft 54 and is fastened thereto by a spring retainer 70 in a manner hereinafter set forth, the knob 69 having a D-shaped opening 71 formed in a surface 72 thereof to receive a similarly shaped portion of the end 55 of the shaft 54 therein whereby the end 55 of the shaft 54 co-operates with the opening 71 so that rotation of the knob 69 causes like rotation of the shaft 54.

Figure 4:
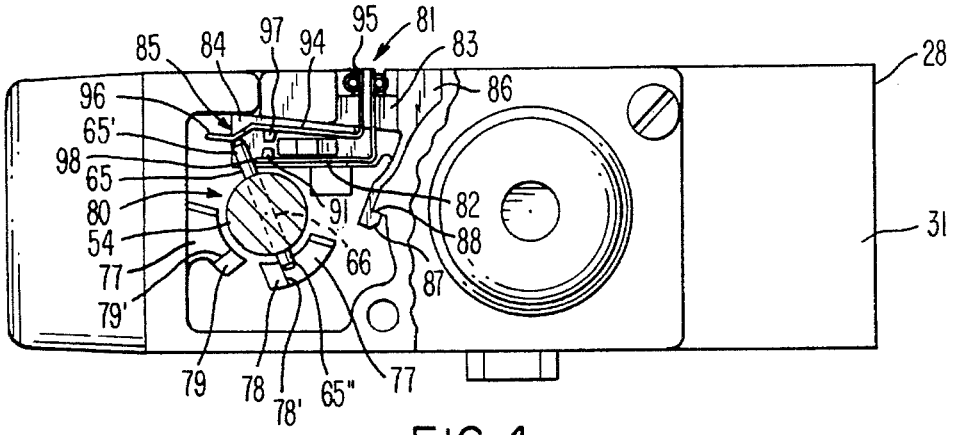
FIG. 4 is a top cross-sectional view of the control device of FIG. 3 and is taken generally in the direction of the arrows 4—4 of FIG. 3.
Figure 3:
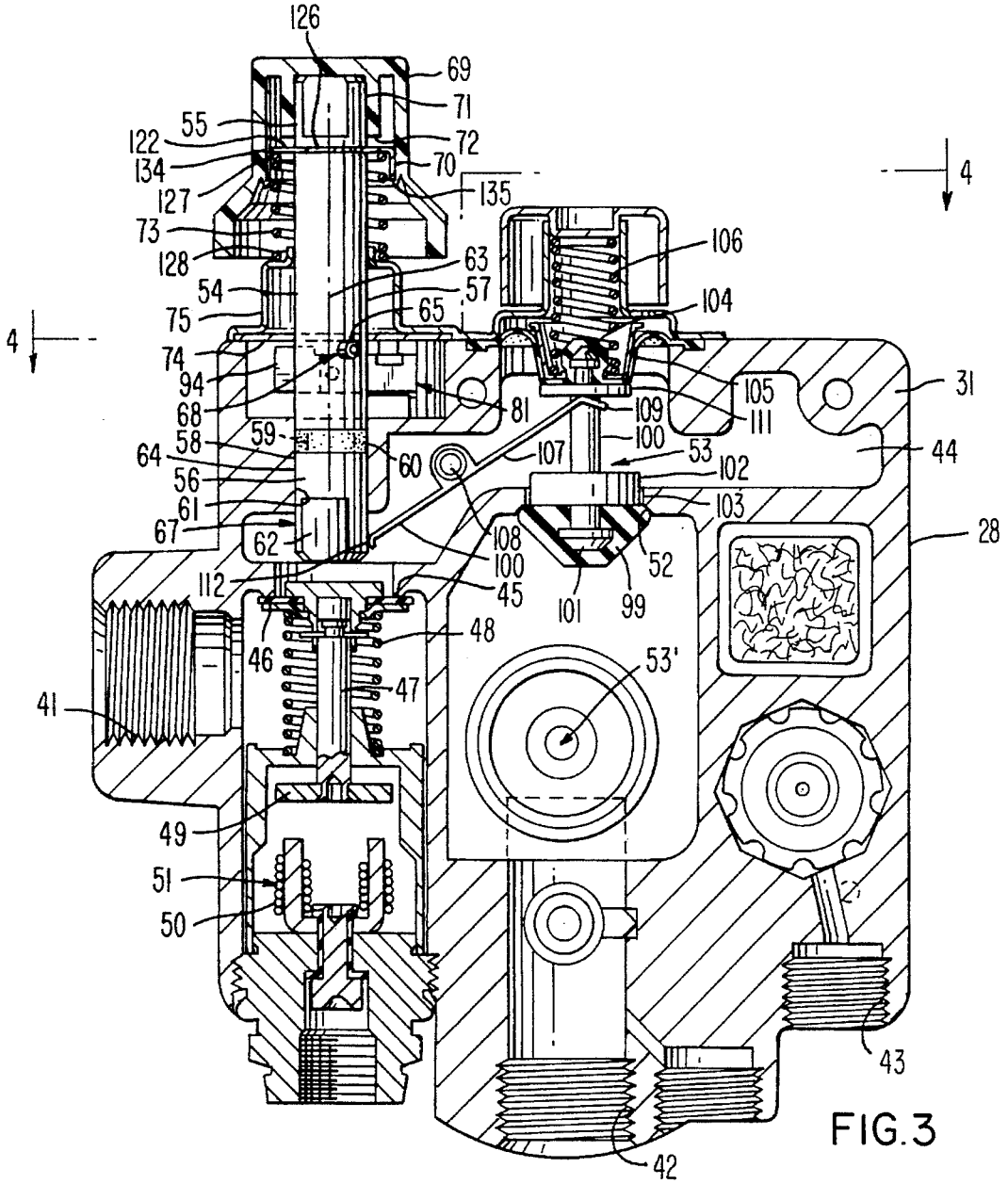
FIG. 3 is an enlarged cross-sectional view of the control device of this invention that is utilized in the system of FIG. 1, the control device of FIG. 3 being disposed in its "off" condition

A compression spring 73 is carried by the housing means 31 and acts against the spring retainer 70 of the control knob 69 to tend to hold the shaft 54 in its up position wherein the pin means 65 of the shaft 54 engages against a washer like member 74 held against the housing means 31 by a secured cover means 75 of the housing means 31 to prevent the shaft 54 from being pulled out of the opening 58 whereby the normal axial position of the shaft 54 is in the out axial position as illustrated in FIGS. 3 and 4. Of course, another pin or other structure could be utilized for this purpose.

Figure 5:
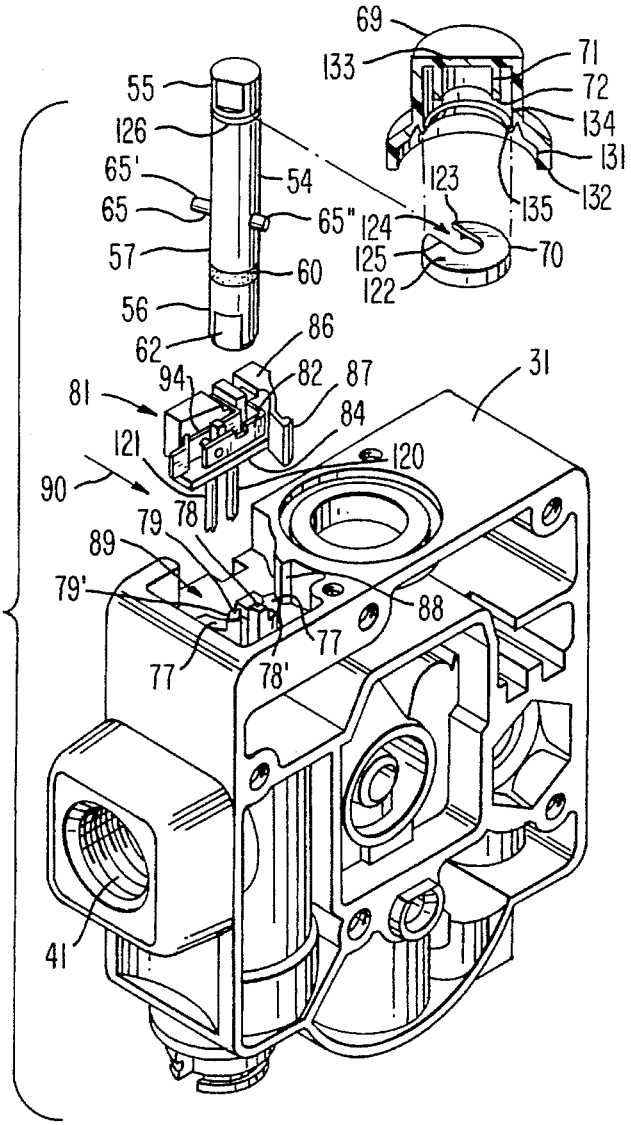
FIG. 5 is a broken away exploded perspective view illustrating certain of the parts of the control device illustrated in FIG. 3.

The pin 65 is carried by the shaft 54 and has opposed ends 65' and 65" that extend radially outwardly therefrom in opposite directions as illustrated in FIG. 5 to cooperate with a surface means 77 on the housing means 31 of the control device 28 so as to be movable between a first stop means 78 that extends upwardly from the surface means 77 to a second stop means 79 that also extends upwardly from the surface means 77 whereby rotational movement of the shaft 54 is controlled by the stop means 78 and 79 as will be apparent hereinafter.

The surface means 77 of the housing means 31 of the control device 28 is interrupted by a slot means 80 that is disposed adjacent one side of the stop means 78 and 79 with the slot means 80 extending downwardly into the housing means 28 so as to permit the shaft 54, when its pin 65 is aligned with the slot means 80, to be moved axially downwardly by the operator pushing down on the control knob 69 in opposition to the force of the compressions spring 73 so that the end 56 of the shaft 54 can engage against the movable valve means 46 and move the same downwardly therewith in opposition to the force of its compression spring 48 to the latching position illustrated in FIG. 6 whereby the now opened valve seat 45 permits fuel to flow to the chamber 44 and, thus, out of the pilot outlet 43 to the pilot burner 37. Thus, it can be seen that when the shaft 54 has been rotated so that the pin 65 is aligned with the slot means 80, the shaft 54 is in its "pilot" position and once the shaft 54 has been pushed axially downwardly to open the valve means 46, the shaft 54 is in its "pilot light" position.

In general, the various structures of the control device 28 previously described are very similar to the control device disclosed in the aforementioned U.S. patent to Schultz, U.S. Pat. No. 5,326,029 whereby this U.S. patent is being incorporated into this disclosure by this reference thereto.

However, the actuator means 68 of the shaft 54 of the control device is uniquely utilized to control an electrical switch means of this invention that is generally indicated by the reference numeral 81 in FIGS. 4, 5, 7 and 9.

While the switch means 81 can have any suitable configuration, the embodiment thereof illustrated in the drawings comprises a first metallic switch blade 82 held in a fixed position by a support means 83 that is formed of electrically insulating material, such as plastic material, and having a first portion 84 for being disposed in a notch 85 in the housing means 31 of the control device 28 while a second portion thereof 86 is adapted to have a lip 87 thereof snapped over a ledge 88 of the housing means 31 to snap-fittingly hold the switch means 81 in its assembled relation in the housing means 31 when the switch means 81 is pushed inwardly into a cooperating cavity 89 formed in the housing means 31 and in the direction of the arrow 90 as illustrated in FIG. 5.

The switch blade 82 has a fixed contact 91 for interconnecting into the electrical circuit means of this invention that is generally indicated by the reference numeral 93 in FIG. 2 and hereinafter described.

Figure 7:
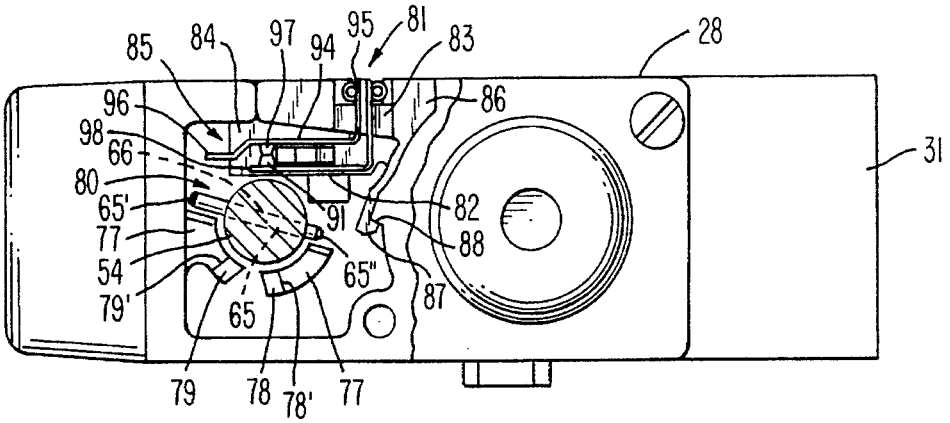
FIG. 7 is a top cross-sectional view of the control device of FIG. 6 and is taken generally in the direction of the arrows 6—6 thereof.
Figure 9:
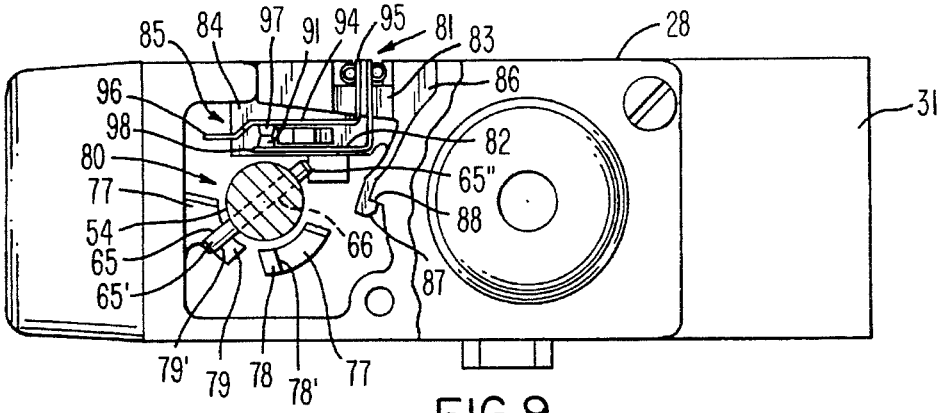
FIG. 9 is a top cross-sectional view of the control device of FIG. 8 and is taken generally in the direction of the arrows 9—9 of FIG. 8.

The support means 83 of the electrical switch means 81 carries a second metallic blade 94 that has one end 95 fixed to the support 83 while the other end 96 of the switch blade 94 is movable relative thereto and carries a contact means 97 for cooperating with the contact means 91, the switch blade 94 having a natural bias to tend to hold the contact 97 against the contact 91 as illustrated in FIGS. 7 and 9 whereby the switch means 81 is a "normally closed" switch means. In contrast, the similar switch means disclosed in the aforementioned U.S. patent to Schultz, U.S. Pat. No. 5,326,029 is a "normally open" switch means.

The end 96 of the switch blade 94 extends beyond an end 98 of the fixed switch blade 82 for a purpose hereinafter described.

When the shaft 54 is disposed in the "off" rotatable position thereof, the end 65" of the pin 65 of the shaft 54 is against a stop surface 78' of the stop means 78 as illustrated in FIG. 4 and the end 65' of the pin 65 is disposed against the end 96 of the movable switch blade 94 and has moved the same so that the contact 97 is held out of contact with the contact 91 so that the switch means 81 is in an open condition thereof.

However, when the shaft 54 is rotated from the "off" position toward the "pilot" position wherein the pin 65 will align with the slot 80 as illustrated in FIG. 7, the end 65' of the pin 65 has moved away from the end 96 of the movable switch blade 94 a sufficient distance to cause the blade 94 to move toward the fixed blade 82 so that the contact 97 is placed in electrical contact with the contact 91 to thereby close the switch means 81 and hold the same in the closed condition thereof as long as the shaft 54 has been rotated out of the "off" position thereof for a purpose hereinafter described. Of course, when the shaft 54 is rotated back to the "off" position thereof where the end 65" of the pin 65 of the shaft 54 is against the stop surface 78', the end 65' of the pin 65 has again moved the movable switch blade 94 away from the switch blade 82 as illustrated in FIG. 4 to open the switch means 81 which will always be in an open condition thereof when the shaft means 54 is disposed in the "off" position thereof. In this manner, it can be seen that the pin means 65 uniquely acts as an actuator means 68 for controlling the switch means 81.

The cam means 62, 64 of the shaft 54 also acts as an actuator means 67 for the pressure regulator valve means 53 of the control device 28 so that when the shaft 54 is disposed in the "off" position thereof, in the "pilot" position thereof and in the "pilot light" position thereof, such as illustrated in FIGS. 3 and 6, a valve member 99 of the pressure regulator valve means 53 is held closed against the valve seat 52 to prevent the fuel from the chamber 44 of the housing means 31 of the control device 28 from reaching the temperature controlled valve means 53' and, thus, to prevent any fuel flow to the main burner means 23. However, when the shaft 54 has been rotated to the "on" position as illustrated in FIGS. 9 and 10 wherein the end 65' of the pin 65 is against the surface means 79' of the stop means 79, the valve member 99 of the pressure regulator valve means 53 is no longer held against the valve seat 52 so that the pressure regulator valve means 53 is disposed in an operating position thereof for controlling the pressure of the fuel that is now permitted to flow through the valve seat 52 to the valve means 53' as will be apparent hereinafter.

The pressure regulator valve means 53 comprises a valve stem 100 that has an end 101 carrying the valve member 99 and a flow controller 102 adjacent the valve member 99, the flow controller 102 being adapted to be disposed in the valve seat passage 103 and thereby control the flow of fuel through the valve seat 52 in a manner well known for pressure regulator valves.

The stem 100 of the pressure regulator valve means 53 has another end 104 carried by a flexible diaphragm 105 that is normally urged toward the valve seat 52 by a compression spring 106 so that the force of the compression spring 106 normally tends to maintain the valve member 99 in an open condition relative to the valve seat 52. The force of the compression spring 106 is adjustable so as to set the pressure valve for the fuel that is permitted to flow through the valve seat 52 in a manner well known in the art.

However, a lever 107 is pivotally mounted to the housing means 31 of the control device 28 by a pivot means 108 located intermediate opposed ends 109 and 110 of the lever 107, the end 109 of the lever 107 engaging against a disc 111 of the stem 100, such as by having the end 109 bifurcated and straddling the stem 100 intermediate the disc 111 and the flow controller 102, and the end 110 being bent to define a cam follower surface 112 engaging against the cam means 67 of the shaft 54 as illustrated in the drawings.

In this manner, the arcuate large surface 64 of the cam means 67 of the shaft 54 when disposed against the surface 112 of the lever 107 pivots the lever 107 in such a manner that the end 109 of the lever 107 moves the stem 100 upwardly against the force of the compression spring 106 to hold the valve member 99 fully seated against the valve seat 52 to thereby prevent a flow of fuel through the valve seat 52 whereby the pressure regulator valve means 53 is disposed in a closed condition thereof. Thus, it is only when the shaft 54 is rotated to the "on" position thereof that the low or flat side 62 of the cam means 67 is disposed adjacent the follower surface 112 of the lever 107 so that the spring means 106 of the pressure regulator valve means 53 can move the diaphragm 105 downwardly and thereby pivot the lever 107 to place the cam follower surface 112 against the flat side 62 of the shaft 54 and thereby permit the valve member 99 to move away from the valve seat 52 as illustrated in FIG. 8. Of course, rotation of the shaft 54 out of the "on" position thereof toward the "pilot" position thereof causes the high side of 64 of the calm means 67 to operate on the end 110 of the lever 107 to close the valve member 99 against the valve seat 52 in opposition to the force of the compression spring 106 for a purpose hereinafter described.

Figure 2:
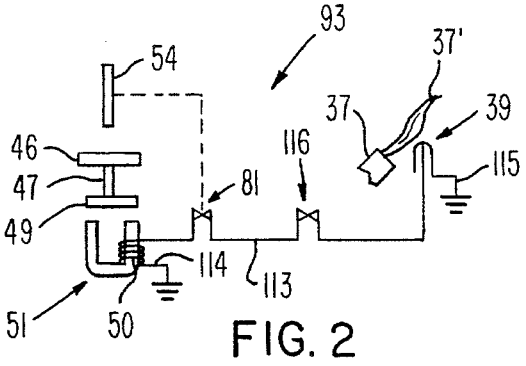
FIG. 2 is a schematic view illustrating the electrical system for the control system of FIG. 1.

As schematically illustrated in FIG. 2, the electrical circuit means 93 for the system 20 of this invention has one part of the thermocouple 39 connected to one end of the coil 50 of the electromagnetic means 51 by a conductor means 113 whereas the other end of the coil 50 is interconnected to ground by a conductor means 114 and the other part of the thermocouple 39 is interconnected to ground by a conductor means 115. The switch means 81 of the control device 28 previously described is disposed in the conductor means 113 intermediate the thermocouple 39 and the coil 50 so as to be in series therewith so that when the switch means 81 is disposed in an open condition the coil means 50 can not be energized by the thermocouple 39. In addition, a conventional temperature operated switch means 116 is also disposed in the conductor means 113 so as to be in series with the thermocouple 39 and the coil means 50 so that if the switch means 116 is in an open condition thereof, the coil means 50 cannot be energized, the switch means 116 being located in the temperature sensing means or unit 35 and being adapted to open should the same sense the temperature of the water 21' in the tank as being approximately 200° F. Such temperature operated switch means is fully disclosed in the aforementioned U.S. patent to Dykzeul, U.S. Pat. No. 3,507,037.

The switch blades 82 and 94 of the electrical switch means 81 are respectively electrically interconnected to electrical lead means 120 and 121 as illustrated in FIG. 5 and such lead means 120 and 121 from part of the lead means 113 of the electrical circuit means 93 of FIG. 2 so that the electrical switch means 81 is disposed in the lead means 113 intermediate the coil means 50 and the electrical switch means 116 in series therewith.

As illustrated in FIG. 5, the spring retainer 70 has a disc-like portion 122 that has an outer peripheral edge means 123 that is interrupted by a slot 124, the slot 124 defining an edge means 125 that is received in an annular slot 126 in the shaft means 54 when the spring retainer 70 is assembled to the shaft means as illustrated in FIGS. 3, 6 and 8. In this manner an end 127 of the compression spring 73 bears against the disc-like portion 122 of the spring retainer 70 and an opposite end 128 of the compression spring bears against the cover means 75. However, the compression spring 73 is first telescoped onto the shaft means 54 after the shaft means 54 has been inserted into the housing opening 58 before the spring retainer 70 is assembled to the shaft means 54.

Thereafter, the control knob 69 is snap-fit onto the spring retainer 70 to be carried thereby and to prevent the spring retainer 70 from shifting on the shaft means 54 so that the spring retainer 70 itself is fastened to the shaft means 54 by the control knob.

In particular, the spring retainer 70 has a skirt 129 depending from the peripheral edge means 123 of the disc-like portion 122 thereof, except at the slot means 124 and adjacent thereto for a short distance, and terminates at a free edge means 130.

The control knob 69 has a stepped opening 131 means that is formed in the end 132 thereof and defines the D-shaped opening 71 and surface means 72 in the opposite end 133 of the control knob 69 as well as defines an intermediate cylindrical chamber 134 that receives the spring retainer 70 therein in a press-fit manner as well as in a snap-fit manner as the control knob 69 has a resilient annual lip 135 that snap-fits over the edge means 130 just slightly before or at the same time that the control knob 69 has the end 133 thereof bottom out onto the end 55 of the shaft means 54 when the control knob is being pushed onto the shaft means 54 and onto the spring retainer 70 so as to be assembled therewith. The skirt 129 of the spring retainer 70 is so sized that the same is press-fit into the intermediate opening 134 of the control knob 69. In this manner, it can be seen that the control knob 69 is fastened to the spring retainer 70 by the lip 135 thereof and because the end 55 of the shaft means 54 is received in the D-shaped opening 71 of the control knob 69, the spring retainer 70 is held from shifting on the shaft means 54 by the control knob 69 whereby the edge means 125 of the spring retainer 70 is held in the annular slot means 126 of the shaft means 54 so that the control knob 69 fastens the spring retainer 70 to the shaft means 54 in the assembled relation thereto as illustrated.

From the above, it can be seen that the control system 20 and the control device 28 of this invention can each be made in a simple and effective manner by the method of this invention previously described so as to operate in a manner now to be described.

With the control knob 69 of the control device 28 disposed in the "off" condition wherein the end 65" of the pin 65 of the shaft 54 is disposed against the surface 78' of the stop 78, as illustrated in FIGS. 3 and 4, not only is the valve means 46 being held against its valve seat 45 by the compression spring 48, but also the high side 64 of the cam means or actuator means 67 of the shaft 54 is engaging the follower surface 112 of the lever 107 so as to hold the lever 107 in a counter clockwise direction to maintain the valve member 99 of the pressure regulator valve means 53 in its closed condition against the valve seat 52 in opposition to the force of the compression spring 106 so that no fuel from the source 24 can pass to either of the burner means 23 and 37, the valve member 46 preventing any flow of fuel to the pilot burner means 37 and the redundancy of the two valve means 46 and 53 in series preventing any flow of fuel to the main burner means 23. In addition, the end 65' of the pin means 65 of the shaft 54 is holding the switch blade 94 in such a position that the contact 97 thereof is out of contact with the fixed contact 91 as illustrated in FIG. 4 whereby the switch means 81 is in the open condition thereof to prevent any flow of electrical current through the coil 50.

Should it be desired to operate the control system 20 so as to heat the water 21' in the tank 22 of the water heater 21, the operator selects the desired temperature for the water 21' by adjusting the control knob 28' to the desired temperature setting thereof and then rotates the control knob 69 to the "pilot" position thereof wherein the pin 65 of the shaft 54 is located over the slot 80 in the surface means 77 of the housing means 31 as illustrated in FIG. 7. Such rotation of the shaft 54 still does not bring the flat area 62 of the cam means 67 of the shaft 54 adjacent the follower surface 112 of the lever 107 so that the valve member 99 of the pressure regulator valve means 53 remains in its closed condition whereas the end 65' of the pin means 65 of the shaft 54 is now moved away from the end 96 of the switch blade 94 of the electrical switch means 81 a sufficient distance so as to cause the natural bias of the switch blade 94 to move the contact 97 into contact with the fixed contact 91 and thereby maintain the switch means 81 in the closed condition thereof so as to permit electrical current to flow through the coil means 50 once the thermocouple 39 detects a flame at the pilot burner means 37, such as flame 37' in FIG. 2.

When the shaft 54 has been rotated to the "pilot" position previously described, the operator then pushes axially downwardly on the same in the manner illustrated in FIG. 6 to engage against the valve means 46 and move the valve means 46 away from the valve seat 45 in opposition to the force of the compression spring 48 to not only open the valve seat 45, but also to place the armature 49 closely adjacent the electromagnetic means 51 so that when a current flows through the coil means 50 of the electromagnetic means 51, the armature 49 will be held in such position of FIG. 6 in opposition to the force of the compression spring 48 even though the shaft 54 is subsequently permitted to move upwardly away from the valve means 46.

With the control device 28 now set in the "pilot light" condition illustrated in FIG. 6, the operator lights the fuel now flowing out of the burner means 37 since the fuel can pass through the open valve seat 45 and chamber 44 to the pilot outlet means 43 as previously stated. When a flame 37', FIG. 2 is created at the pilot burner means 37, it can be seen that because the switch means 81 and 116 are each in the closed condition thereof, electrical current created by the thermocouple 39 can now flow through the coil means 50 and such current will continue to flow through the coil means 50 as long as the flame 37' remains at the pilot burner means 37.

The creation of the current flow through the coil 50 of the electromagnetic means 51 causes the armature 49 of the valve means 46 to now be held in the position of FIG. 6 so that the operator can release his force pushing downwardly on the knob 69 so that the knob 69 can now return to its fully up position by the force of the compression spring 73 wherein the pin 65 of the shaft 54 engages the washer 74 of the housing means 28 under the force of the compression spring 73 so that the pin 65 of the shaft 54 is now above the surface means 77 of the housing means 31 at the slot 80. With the shaft 54 now in this "pilot" position, the pilot burner 37 will continue to have fuel directed thereto as the valve means 46 is being held in an open condition by the electromagnetic means 51.

The operator then rotates the control knob 69 to the "on" position of the shaft 54 wherein the end 65' of the pin 65 is disposed against the surface means 79' of the stop means 79 and before the pin 65 reaches the stop surface means 79', the low or flat surface 62 of the cam means 67 is now positioned adjacent the follower surface 112 of the lever 107 so that the lever 107 can pivot in a clockwise direction to place the follower surface 112 against the flat surface 62 under the force of the compression spring 106 moving the stem 100 of the valve member 99 downwardly as illustrated in FIG. 8 to remove the holding force that the lever 107 previously placed on the valve member 99 to close the same against the valve seat 52 so that the pressure regulator valve means 53 is now operative to control the pressure of the fuel that is now permitted to pass through the valve seat 52 to reach the valve means 53'. Also, it can be seen that the switch means 81 remains closed with the shaft 54 in its "on" position.

If the temperature of the water 21' in the water tank 22 is at this time below the temperature selected by the knob 28', the rod and tube temperature sensing means 35 will have opened the valve means 53' to permit fuel to flow to the main burner means 23 to be ignited by the pilot burner means 37 so that the fuel now burning at the main burner means 23 will heat the water 21' in the tank 22 by conduction. When the temperature of the water 21' subsequently reaches the temperature selected by the knob 28', the rod and tube temperature sensing means 35 will close the valve means 53' to terminate the flow of fuel to the burner means 23.

Thus, the rod and tube temperature sensing means 35 will open and close the valve means 53' in a manner well known in the art to tend to maintain the temperature of the water 21' in the water tank 22 at the temperature selected by the control knob 28'.

As previously stated, should the temperature of the water 21' in the tank 22 for some reason reach the high limit temperature condition for operating the switch means 116, such as through a runaway condition of the burner means 23, the switch means 116 will open and thereby terminate the flow of current through the coil means 50 of the electromagnetic means 51 so that the compression spring 48 will close the valve member 46 against the valve seat 45 to terminate the flow of fuel to the burner means 23 as well as to the pilot burner means 37 requiring a subsequent relighting of the pilot burner means 37 in the manner previously described once the switch means 116 closes.

If for some reason, the operator wants to turn off the system 20, the operator can rotate the control knob 69 of the shaft 54 back to the "off" position wherein the end 65" of the pin means 65 of the shaft 54 is disposed against the stop surface means 78' and under such condition, the switch means 81 will be opened by the end 65' of the pin means 65 in the manner previously described and the valve member 99 of the pressure regulator valve means 53 will be held against the valve seat 52 by the cam means 67 in the manner previously described so that the opening of the switch means 81 causes the electrical current to cease to flow through the coil means 50 whereby the valve member 46 will be closed against the valve seat 45 by the spring 48 to terminate the flow of fuel to the pilot burner means 37 and thereby terminate the flame 37' while the closing of the valve member 99 of the pressure regulator valve means 53 as well as the closing of the valve member 46 against the valve seat 45 terminates the flow of fuel to the main burner means 23.

While the description and operation of the system 20 and control device 28 of this invention previously described has provided a pilot burner means 37 for the main burner means 23, it is to be understood that the pilot burner means 37 could be eliminated and that a small flame can be provided at the main burner means 23 when the shaft 54 is moved axially downwardly in its "pilot light" position as the small flow of fuel normally out of the outlet means 43 to the pilot burner means could be directed by the housing means 28 to the main burner means 23 whereby the flame detecting means 39 will detect the small flame at the main burner means 23 which will thereafter have a full flow of fuel thereto when the shaft 54 is rotated to the "on" position for the reasons previously set forth.

In any event, it can be seen that the pin means 65 of the shaft 54 uniquely performs a dual function, namely, controls the rotational and axial movements of the shaft 54 and also controls the operation of the switch means 81, the ends 65' and 65" of the pin 65 only permitting the axial movement of the shaft 54 to the pilot light position of FIG. 6 because in any other rotational position of the shaft 54, one of the ends 65' or 65" of the pin will be in alignment with the respective stop means 79 or 78 to prevent the shaft 54 from being axially moved in an inward manner relative to the housing means 31.

In addition, the ends 65' and 65" of the shaft 54 control the rotational movement of the shaft 54 by cooperating with the stop surfaces 79' and 78' only when the shaft 54 is in its "out" axial position of FIGS. 3 and 8 as the stop means 78 and 79 prevent rotation of the shaft 54 when the shaft 54 is in its "in" axial position of FIG. 6 as the ends 65' and 65" of the pin means 65 will hit such stop means 79 and 78 if the shaft 54 is slightly rotated while in such "in" position.

Therefor, it can be seen that this invention not only provides a new control device, but also this invention provides a new method of making such a control device.

While the forms and methods of this invention now preferred have been illustrated and described as required by the Patent Statute, it is to be understood that other forms and methods can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control device comprising a housing means, an electromagnetic means carried by said housing means, a movable valve means carried by said housing means and normally being disposed in a first operating position thereof and being adapted to be held in a second operating position thereof by said electromagnetic means as long as said electromagnetic means remains energized, electrical switch means carried by said housing means and being operatively interconnected to said electromagnetic means so that said electromagnetic means is adapted to be energized when said switch means is in a first operating condition thereof and is prevented from being energized when said switch means is in a second operating condition thereof, and a shaft means carried by said housing means and being adapted to be axially moved from a first axial position thereof to a second axial position thereof so as to engage said valve means and move said valve means from said first operating position thereof to said second operating position thereof, said shaft means having actuator means operatively interconnected to said switch means and being rotatably movable from a first rotatable position thereof to a second rotatable position thereof to cause said switch means to be in said first operating condition thereof, the improvement wherein said switch means comprises contact means normally disposed in the closed condition thereof which comprises said first operating condition of said switch means thereof and wherein said actuator means of said shaft means engages and holds said contact means in an open condition thereof when said shaft means is in said first rotatable position thereof whereby said open condition of said contact means comprises said second operating condition of said switch means.

2. A control device as set forth in claim 1 wherein said actuator means of said shaft means comprises a pin means carried by said shaft means.

3. A control device as set forth in claim 2 wherein said contact means comprises a fixed contact means and a movable contact means that has a normal bias tending to move and hold said movable contact means against said fixed contact means, said pin means having a part thereof extending radially outwardly from said shaft means and being engageable with said movable contact means and moving said movable contact means out of contact with said fixed contact means as said shaft means is moved to said first rotatable position thereof.

4. A control device as set forth in claim 3 wherein said shaft means and said housing means respectively have cooperating means that act together to permit said shaft means to be axially moved from said first axial position thereof to said second axial position thereof only when said shaft means is in said second rotatable position thereof.

5. A control device as set forth in claim 4 wherein said cooperating means of said shaft means comprises said pin means thereof.

6. A control device as set forth in claim 5 wherein said cooperating means of said housing means comprises slot means in said housing means that receives said pin means axially therein when said shaft means is in said second rotatable position thereof.

7. A control device as set forth in claim 2 wherein said pin means has opposed ends thereof respectively extending radially outwardly from said shaft means in opposite directions therefrom, said housing means having two spaced apart stop means, one of said opposed ends of said pin means engaging one of said stop means when said shaft means is in said first rotatable position.

8. A control device as set forth in claim 7 wherein the other of said opposed ends of said pin means engages the other of said stop means when said shaft means is in a third rotatable position thereof.

9. A control device as set forth in claim 8 wherein said housing means has slot means that is adapted to receive said opposed ends of said pin means therein when said shaft means is in said second rotatable position thereof and being axially moved from said first axial position thereof toward said second axial position thereof.

10. A control device as set forth in claim 9 wherein said two stop means are disposed on one side of said slot means.

11. In a method for making a control device comprising a housing means, an electromagnetic means carried by said housing means, a movable valve means carried by said housing means and normally being disposed in a first operating position thereof and being adapted to be held in a second operating position thereof by said electromagnetic means as long as said electromagnetic means remains energized, electrical switch means carried by said housing means and being operatively interconnected to said electromagnetic means so that said electromagnetic means is adapted to be energized when said switch means is in a first operating condition thereof and is prevented from being energized when said switch means is in a second operating condition thereof, and a shaft means carried by said housing means and being adapted to be axially moved from a first axial position thereof to a second axial position thereof so as to engage said valve means and move said valve means from said first operating position thereof to said second operating position thereof, said shaft means having actuator means operatively interconnected to said switch means and being rotatably movable from a first rotatable position thereof to a second rotatable position thereof to cause said switch means to be in said first operating condition thereof, the improvement comprising the steps of forming said switch means to comprise contact means normally disposed in the closed condition thereof which comprises said first operating condition of said switch means thereof, and forming said actuator means of said shaft means to engage and hold said contact means in an open condition thereof when said shaft means is in said first rotatable position thereof whereby said open condition of said contact means comprises said second operating condition of said switch means.

12. A method as set forth in claim 11 and comprising the step of forming said actuator means of said shaft means to comprise a pin means carried by said shaft means.

13. A method as set forth in claim 12 and comprising the steps of forming said contact means to comprise a fixed contact means and a movable contact means that has a normal bias tending to move and hold said movable contact means against said fixed contact means, and forming said pin means to have a part thereof extending radially outwardly from said shaft means and being engageable with said movable contact means and moving said movable contact means out of contact with said fixed contact means as said shaft means is moved to said first rotatable position thereof.

14. A method as set forth in claim 13 and comprising the step of forming said shaft means and said housing means to respectively have cooperating means that act together to permit said shaft means to be axially moved from said first axial position thereof to said second axial position thereof only when said shaft means is in said second rotatable position thereof.

15. A method as set forth in claim 14 and comprising the step of forming said cooperating means of said shaft means to comprises said pin means thereof.

16. A method as set forth in claim 15 and comprising the step of forming said cooperating means of said housing means to comprise slot means in said housing means that receives said pin means axially therein when said shaft means is in said second rotatable position thereof.

17. A method as set forth in claim 12 and comprising the steps of forming said pin means to have opposed ends thereof respectively extending radially outwardly from said shaft means in opposite directions therefrom, and forming said housing means to have two spaced apart stop means so that one of said opposed ends of said pin means engages one of said stop means when said shaft means is in said first rotatable position.

18. A method as set forth in claim 17 and comprising the step of forming the other of said opposed ends of said pin means to engage the other of said stop means when said shaft means is in a third rotatable position thereof.

19. A method as set forth in claim 18 and comprising the step of forming said housing means to have slot means that is adapted to receive said opposed ends of said pin means therein when said shaft means is in said second rotatable position thereof and being axially moved from said first axial position thereof toward said second axial position thereof.

20. A method as set forth in claim 19 and comprising the step of disposing said two stop means on one side of said slot means.

* * * * *